US010094140B2

(12) United States Patent
Chen

(10) Patent No.: US 10,094,140 B2
(45) Date of Patent: Oct. 9, 2018

(54) DOOR OPENING AND CLOSING STRUCTURE

(71) Applicant: APEX BILLION INT'L INV. LTD., Taipei (TW)

(72) Inventor: Yuan-Chen Chen, Taipei (TW)

(73) Assignee: APEX BILLION INT'L INV. LTD., Taipei (TW)

( * ) Notice: Subject to any disclaimer, the term of this patent is extended or adjusted under 35 U.S.C. 154(b) by 0 days.

(21) Appl. No.: 15/787,723

(22) Filed: Oct. 19, 2017

(65) Prior Publication Data

US 2018/0106070 A1 Apr. 19, 2018

(30) Foreign Application Priority Data

Oct. 19, 2016 (CN) ..... 2016 1 0908810
Jul. 13, 2017 (CN) ..... 2017 1 0570019

(51) Int. Cl.

| | |
|---|---|
| ***E04H 15/58*** | (2006.01) |
| ***E06B 9/56*** | (2006.01) |
| ***E06B 9/06*** | (2006.01) |
| ***E06B 9/64*** | (2006.01) |
| ***E06B 9/262*** | (2006.01) |
| ***E06B 9/58*** | (2006.01) |

(Continued)

(52) U.S. Cl.

CPC ..... *E04H 15/58* (2013.01); *E04H 15/008* (2013.01); *E04H 15/50* (2013.01); *E05F 11/04* (2013.01); *E06B 9/0692* (2013.01); *E06B 9/262* (2013.01); *E06B 9/56* (2013.01); *E06B 9/581* (2013.01); *E06B 9/64* (2013.01); *E06B 9/66* (2013.01); *E06B 2009/2622* (2013.01); *E06B 2009/583* (2013.01); *E06B 2009/588* (2013.01)

(58) Field of Classification Search

CPC ..... E04H 15/58; E05F 11/04; E05F 11/54; E06B 9/262; E06B 9/56; E06B 9/581; E06B 9/64; E06B 9/66; E06B 2009/583; E06B 2009/588; E06B 9/0692; E06B 2009/2622

See application file for complete search history.

(56) References Cited

U.S. PATENT DOCUMENTS 1,925,815 A * 9/1933 Nicolson ..... E04H 6/02 135/119
2,336,899 A * 12/1943 Stern ..... E06B 9/64 160/243

(Continued)

FOREIGN PATENT DOCUMENTS

CA 2814265 A1 * 7/2013 ..... E06B 9/40
CH 304238 A * 12/1954 ..... E06B 9/64

(Continued)

*Primary Examiner* — Robert Canfield
(74) *Attorney, Agent, or Firm* — JCIPRNET

(57) ABSTRACT

The invention relates to a door opening and closing structure including a door plate, a transverse bar, a zipper and a pulling string. When a tension is applied on the pulling string and the tension is greater than a gravity of the transverse bar and at least a portion of the door plate, and the at least a portion of the door plate is driven by the transverse bar to move along the extension direction to form an opening. When the tension is less than the gravity of the transverse bar and the at least a portion of the door plate, the door plate is driven by the transverse bar to move along the gravity direction to reduce the opening.

16 Claims, 14 Drawing Sheets

(51) Int. Cl.

| | |
|---|---|
| ***E06B 9/66*** | (2006.01) |
| ***E05F 11/04*** | (2006.01) |
| ***E04H 15/00*** | (2006.01) |
| ***E04H 15/50*** | (2006.01) |

(56) References Cited

U.S. PATENT DOCUMENTS

| | | | | | |
|---|---|---|---|---|---|
| 4,197,897 | A * | 4/1980 | Correa | E06B 9/262 | 160/113 |
| 4,221,256 | A * | 9/1980 | Karaki | A44B 19/26 | 160/368.1 |
| 4,962,782 | A | 10/1990 | Landrum | | |
| 5,193,602 | A * | 3/1993 | Morales | B60P 3/343 | 160/243 |
| 5,785,105 | A * | 7/1998 | Crider | E06B 9/13 | 160/243 |
| 5,819,474 | A * | 10/1998 | Strom | E04H 15/32 | 52/4 |
| 2016/0258212 | A1 * | 9/2016 | Thompson | A62C 2/10 | |

FOREIGN PATENT DOCUMENTS

| | | | | |
|---|---|---|---|---|
| CH | 330384 A * | 5/1958 | E06B 9/64 | |
| CN | 103669985 | 3/2014 | | |
| TW | 441956 | 6/2001 | | |
| TW | I408075 | 9/2013 | | |

* cited by examiner

DOOR OPENING AND CLOSING STRUCTURE

CROSS-REFERENCE TO RELATED APPLICATION

This application claims the priority benefits of Chinese application serial No. 201610908810.6, filed on Oct. 19, 2016 and Chinese application serial No. 201710570019.3, filed on Jul. 13, 2017. The entirety of each of the above-mentioned patent applications is hereby incorporated by references herein and made a part of specification.

BACKGROUND OF THE INVENTION

Field of the Invention

The invention relates to a door opening and closing structure and more particularly relates to a door opening and closing structure with a zipper.

Description of Related Art

Tent is portable equipment that can be used as a shelter from wind and rain or for activities outdoors. Tent is mainly for purposes, such as field operation, travel, disaster relief service, medical treatment, military use, and so on. The entrance of a conventional tent is formed by rolling up the tent door and tying it above the entrance with string. Such a system, however, requires the user to manually roll up the door to form the entrance, which may be rather inconvenient.

SUMMARY OF THE INVENTION

The invention provides a door opening and closing structure for forming an opening that is easy and convenient to operate.

According to an embodiment of the invention, a door opening and closing structure is provided, which includes a door plate, a transverse bar, a zipper, and a pulling string. The transverse bar is connected to the door plate. The transverse bar is connected to the zipper. The pulling string is connected to the transverse bar. When a tension is applied on the pulling string and the tension is greater than a gravity of the transverse bar and at least a portion of the door plate, the transverse bar is pulled by the pulling string along an extension direction of the zipper to pull open at least a portion of the zipper, and the at least a portion of the door plate is driven by the transverse bar to move along the extension direction to form an opening. When the tension is less than the gravity of the transverse bar and the at least a portion of the door plate, the transverse bar moves along a gravity direction to close the at least a portion of the zipper and the door plate is driven by the transverse bar to move along the gravity direction to reduce the opening.

In an embodiment of the invention, the door opening and closing structure further includes a pulley set. The pulling string is disposed around the pulley set and tied to the transverse bar, and the pulley set changes a transmission direction of the tension applied on the pulling string.

In an embodiment of the invention, the pulley set includes a plurality of fixed pulleys, and the fixed pulleys are located on the door plate.

In an embodiment of the invention, the fixed pulleys are double groove fixed pulleys.

In an embodiment of the invention, the door plate further includes a sleeve located at a bottom of the door plate, and the transverse bar is disposed through the sleeve.

In an embodiment of the invention, the pulling string is respectively tied to a first position and a second position of the sleeve, and the first position and the second position are respectively adjacent to two opposite ends of the sleeve.

In an embodiment of the invention, the door opening and closing structure further includes a door side plate. The door side plate is located on two sides of the door plate, and the door plate and the door side plate are connected by the zipper.

In an embodiment of the invention, the door opening and closing structure further includes an upright post, a base, a fixing pole, and a door side plate fixing buckle. The upright post supports the door side plate and is disposed on the base. The fixing pole is disposed through the base and is fixed to the door side plate. The door side plate fixing buckle is fixed to the door side plate and the fixing pole.

In an embodiment of the invention, the door opening and closing structure further includes a plurality of moving members. One the moving member includes a sliding groove, and the fixing pole includes a housing space and a locking part. One the moving members is movably disposed in the housing space. The locking part is disposed through the fixing pole to reach the sliding groove such that the moving member is movable relative to the fixing pole in an extension direction of the sliding groove, and the transverse bar and the moving member are joined to each other.

In an embodiment of the invention, the transverse bar further includes a connection buckle, and the connection buckle of the transverse bar is buckled to the zipper.

In an embodiment of the invention, the connection buckle is adjacent to two ends of the transverse bar, and the connection buckle is buckled to a zipper head of the zipper.

In an embodiment of the invention, the door opening and closing structure further includes a plurality of positioning parts that are disposed along an extension direction of the pulling string to position the pulling string.

In an embodiment of the invention, the door opening and closing structure further includes a first hook. The pulling string is adapted to be fixed to the first hook.

In an embodiment of the invention, the door opening and closing structure further includes a plurality of second hooks and a plurality of connection parts. The transverse bar includes a plurality of openings that are respectively located on two sides of the transverse bar. An end of one of the connection parts is disposed through the zipper head of the zipper, another end of one of the connection parts is disposed through an end of one of the second hooks, and another end of one of the second hooks is disposed through one of the openings.

In an embodiment of the invention, the door opening and closing structure further includes an adhesive part. The zipper is a detachable zipper. The adhesive part is located on two sides of the detachable zipper. The detachable zipper is connected to the door side plate via the adhesive part.

In an embodiment of the invention, the door opening and closing structure further includes a sub-zipper. The zipper is a detachable zipper. The sub-zipper is located on two sides of the detachable zipper. The detachable zipper is connected to the door side plate via the sub-zipper.

Based on the above, the door opening and closing structure of the embodiments of the invention pulls up (or lowers) the transverse bar via the pulling string, and the pulling string drives the transverse bar to pull open (or close) at least a portion of the zipper, such that the door plate forms (or closes) the opening of the door opening and closing structure. In comparison with the conventional technology, the door opening and closing structure of the embodiments of the invention does not need to open the entrance of the door opening and closing structure in a rolling-up manner, and the operation of forming the opening is easy and convenient.

In order to make the aforementioned and other features and advantages of the invention more comprehensible, several embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate exemplary embodiments of the invention and, together with the description, serve to explain the principles of the invention.

DESCRIPTION OF THE EMBODIMENTS

Figure 1A:
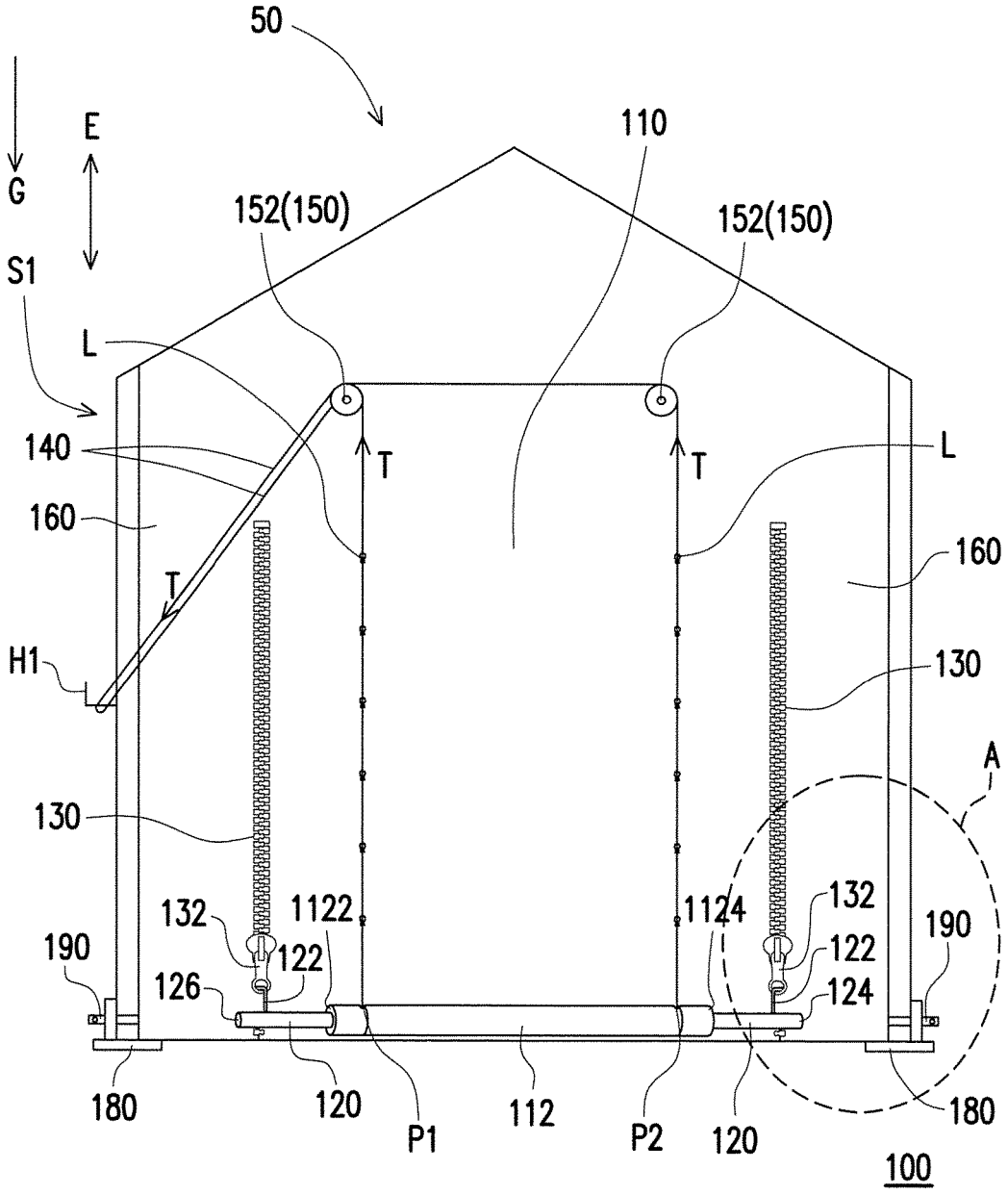
FIG. 1A is an external schematic diagram of the main body combined with the door opening and closing structure according to an embodiment of the invention.
Figure 2A:
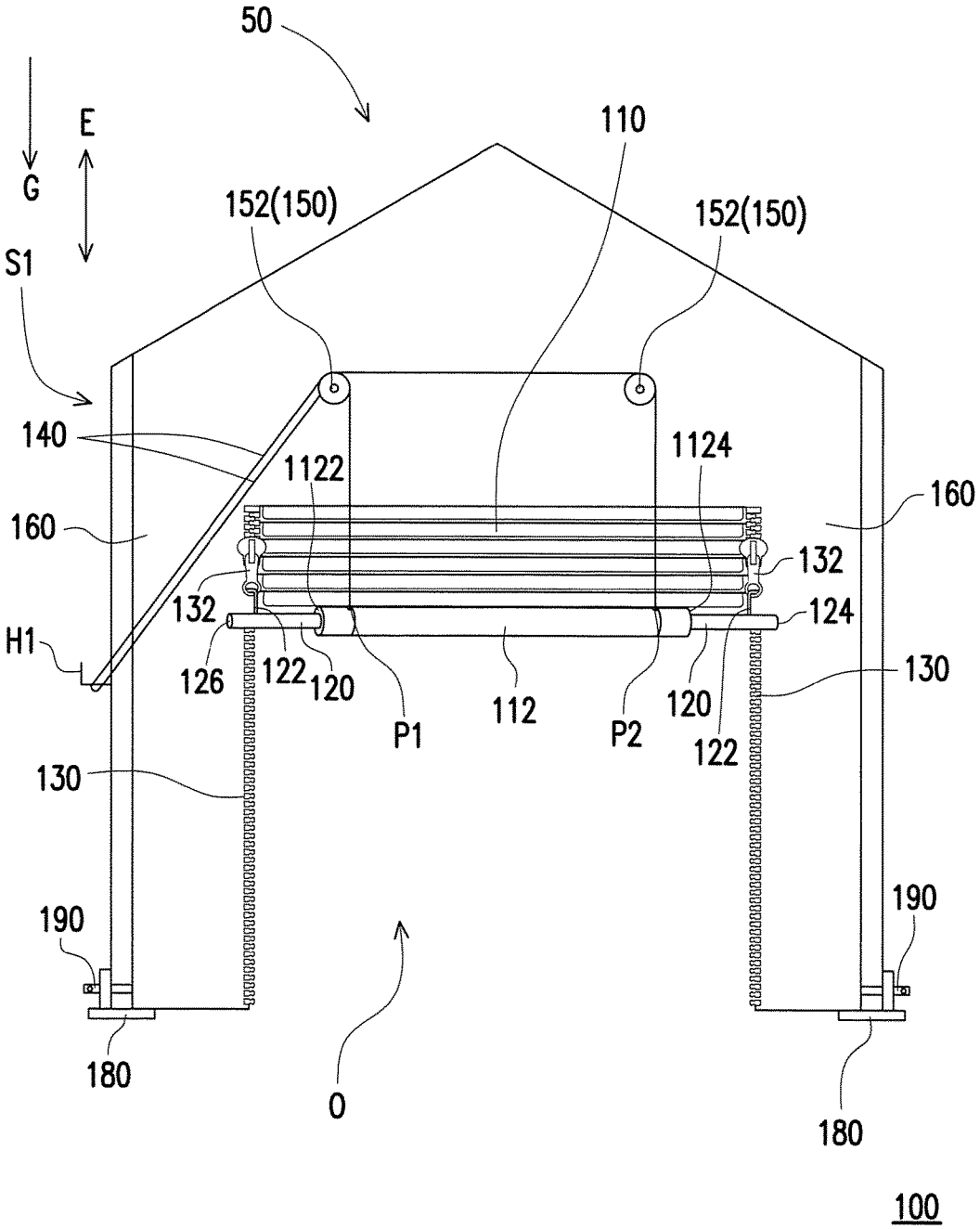
FIG. 2A is a schematic diagram of the state when the door opening and closing structure of the embodiment of FIG. 1A is opened.
Figure 3:
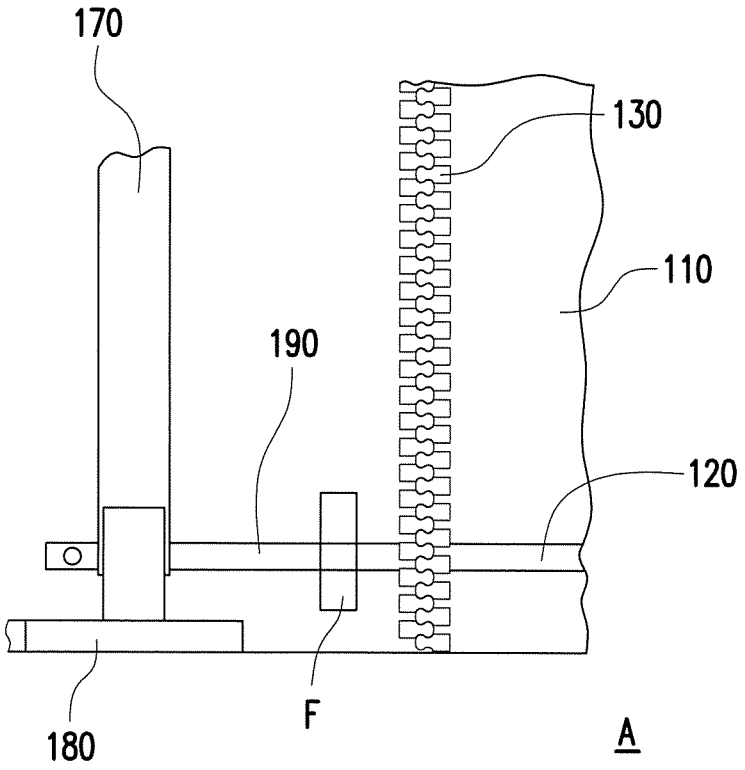
FIG. 3 is an internal schematic diagram of the region A of FIG. 1A.

FIG. 1A is an external schematic diagram of a main body combined with a door opening and closing structure according to an embodiment of the invention. FIG. 2A is a schematic diagram of a state when the door opening and closing structure of the embodiment of FIG. 1A is opened. FIG. 3 is a perspective diagram of a region A of FIG. 1A. In order to clearly illustrate the invention, an upright post 170, a base 180, a fixing pole 190, and a door side plate fixing buckle F are omitted from FIG. 2A. Moreover, the external schematic diagram of FIG. 1A illustrates a situation when the door opening and closing structure is viewed in a direction from the outside of the main body.

First, referring to FIG. 1A and FIG. 2A, in this embodiment, a door opening and closing structure 100 includes a door plate 110, a transverse bar 120, a zipper 130, and a pulling string 140. The door plate 110 is a foldable door plate, for example. The transverse bar 120 is connected to the door plate 110. The transverse bar 120 is connected to the zipper 130. More specifically, the transverse bar 120 includes a connection buckle 122. The connection buckle 122 of the transverse bar 120 is buckled to the zipper 130. The pulling string 140 is connected to the transverse bar 120. The door opening and closing structure 100 is adapted to be combined with a main body 50 for shielding or opening an internal space (not shown) of the main body 50. In this embodiment, the main body 50 is a tent, for example. In other embodiments, the main body 50 is a facility, such as a factory, an outdoor large-scale facility, and so on, which requires a door opening and closing function, for example, but the invention is not limited thereto.

To be more specific, in this embodiment, the connection buckles 122 of the transverse bar 120 are adjacent to two opposite ends 124 and 126 of the transverse bar 120. The connection buckle 122 is buckled to a zipper head 132 of the zipper 130. The door plate 110 further includes a sleeve 112 that is located at the bottom of the door plate 110. The transverse bar 120 is inserted into the sleeve 112. That is, the transverse bar 120 is connected to the door plate 110 through the sleeve 112. The sleeve 112 is for fixing the transverse bar 120, such that the transverse bar 120 and the sleeve 112 are not movable relative to each other. The pulling string 140 is respectively tied to a first position P1 and a second position P2 of the sleeve 112. The first position P1 and the second position P2 are respectively adjacent to two opposite ends 1122 and 1124 of the sleeve 112. That is, the pulling string 140 is tied to the sleeve 112, into which the transverse bar 120 is inserted, to be connected to the transverse bar 120. In addition, a distance from the first position P1 to the end 1122 of the sleeve 112 and a distance from the second position P2 to the other end 1124 of the sleeve 112 are both 300 mm, for example. Nevertheless, the invention is not limited thereto.

Moreover, the door opening and closing structure 100 further includes a pulley set 150 and a door side plate 160. The pulling string 140 is around the pulley set 150 and is connected to the transverse bar 120. The door side plate 160 is located on two sides of the door plate 110. The door plate 110 and the door side plate 160 are connected by the zipper 130. To be more specific, the pulley set 150 includes a plurality of fixed pulleys 152. Two fixed pulleys 152 are disposed in this embodiment, for example. Nevertheless, the invention is not limited thereto. The fixed pulleys 152 are located above the door plate 110, and are located on two sides on the upper side of the door plate 110, for example. In this embodiment, the transverse bar 120, the zipper 130, the pulling string 140, and the pulley set 150 are located on the external side with respect to the door plate 110 (i.e., the outside of the main body 50), for example. Nevertheless, the invention is not limited thereto.

To be more specific, the fixed pulley 152 is a double groove fixed pulley, for example. A portion of the pulling string 140 goes around a groove (not shown) of the left fixed pulley 152 in FIG. 1A and FIG. 2A and extends downward to be lied to the first position P1 of the sleeve 112. Another portion of the pulling string 140 goes around a groove (not shown) of the right fixed pulley 152 in FIG. 1A and FIG. 2A and extends downward to be lied to the second position P2 of the sleeve 112, and another portion of the pulling string 140 extends from the right fixed pulley 152 in FIG. 1A and FIG. 2A to another groove (not shown) of the left fixed pulley 152 in FIG. 1A and FIG. 2A to further extend to a side S1 of the door opening and closing structure 100. Thus, the door opening and closing structure 100 of this embodiment is suitable to be operated by one single person on the same side S1. Nevertheless, the invention is not limited to the embodiment of using the fixed pulleys 152.

Referring to FIG. 1A and FIG. 2A, the user (not shown) applies a tension T on the pulling string 140. The pulley set 150 is for changing a transmission direction of the tension T applied on the pulling string 140. That is, when the user applies the tension T obliquely downward on the pulling string 140 on the side S1 of the door opening and closing structure 100, the transmission direction of the tension T is changed by the pulley set 150 (opposite to a gravity direction G, for example), such that the pulling string 140 close to the door plate 110 applies the tension T upward to at least a portion of the door plate 110 and the transverse bar 120.

Referring to FIG. 2A, when the user applies the tension T on the pulling string 140 and the tension T is greater than the gravity of the transverse bar 120 and at least a portion of the door plate 110, the transverse bar 120 is pulled by the pulling string 140 along an extension direction E of the zipper 130 to pull open at least a portion of the zipper 130. At least a portion of the door plate 110 is driven by the transverse bar 120 to be moved along the extension direction E and folded to form an opening O for communicating the inside of the main body 50 with the outside. On the other hand, referring to FIG. 1A, when the tension T applied by the user is less than the gravity of the transverse bar 120 and at least a portion of the door plate 110, the transverse bar 120 moves along the gravity direction G and closes at least a portion of the zipper 130, and the door plate 110 is driven by the transverse bar 120 to move along the gravity direction G to narrow the opening O (In FIG. 1A, the opening O is closed to shield the inside of the main body 50. That is, the door plate 110 and the door side plate 160 are completely connected by the zipper 130. In other situations, a portion of the door plate 110 and a portion of the door side plate 160 may be connected by the zipper 130 to achieve the effect of narrowing the opening O). In this embodiment, the transverse bar 120 may simultaneously open (or close) at least a portion of the zipper 130 on two sides of the door plate 110 to form (or close) the opening O.

It should be mentioned that, in this embodiment, the pulling string 140 is respectively tied to the first position P1 and the second position P2 of the sleeve 112, and therefore, when the user applies the tension T, the tension T only needs to reach half of the gravity of at least a portion of the door plate 110 and the transverse bar 120 to drive at least a portion of the door plate 110 to be folded up to form the opening O. In other words, the door opening and closing structure 100 of this embodiment achieves the effect of saving strength.

As described above, the door opening and closing structure 100 of this embodiment pulls up (or lowers) the transverse bar 120 via the pulling string 140 and uses the pulling string 140 to drive the transverse bar 120 to pull open (or close) at least a portion of the zipper 130, such that the door plate 110 forms (or closes) the opening O of the door opening and closing structure 100. In comparison with the conventional technology, the door opening and closing structure 100 of this embodiment does not need to open the entrance of the main body 50 (e.g., tent) in a rolling-up manner, and thus the operation of forming the opening O is easy and convenient.

Referring to FIG. 1A again, in this embodiment, the door opening and closing structure 100 further includes a plurality of positioning parts L and a hook H. The positioning parts L are positioning rings, for example. The positioning parts L are disposed along the extension direction E of the pulling string 140. The positioning parts L are for positioning the pulling string 140. For example, referring to FIG. 1A and FIG. 2A, when the user applies the tension T on the pulling string 140 to move and fold up at least a portion of the door plate 110 and the transverse bar 120 to form the opening O, if the opening O is as large as the user desires, the user positions the pulling string 140 to the positioning part L (In FIG. 2A, the pulling string 140 is positioned to the highest positioning part L, for example), and the pulling string 140 is adapted to be tied to a first hook H1, so as to fix the pulling string 140. In addition, the aforementioned operation also defines the size of the opening O. Therefore, the door opening and closing structure 100 of this embodiment operates smoothly and has a beautiful shape.

Referring to FIG. 1A and FIG. 3, in this embodiment, the main body 50 further includes the upright post 170 and the base 180. The door opening and closing structure 100 further includes the fixing pole 190 and the door side plate fixing buckle F. The upright post 170 supports the door side plate 160. The upright post 170 is disposed on the base 180. The fixing pole 190 is disposed through the base 180, and the fixing pole 190 is fixed to the door side plate 160 to prevent the door side plate 160 from swinging around. Thus, the zipper head 132 of the zipper 130 does not swing around with the door side plate 160 and moves smoothly up and down. The door side plate fixing buckle F is fixed to the door side plate 160 and the fixing pole 190. The door side plate fixing buckle F is fixed to the door side plate 160 by welding, for example. The fixing pole 190 is fixed to the base 180 by the aforementioned method. Therefore, the door opening and closing structure 100 of this embodiment is stable, firm, and easy to assemble and disassemble.

It should be noted that, in the following embodiment, reference will be made to part of the contents of the above embodiment, and the repeated technical content will be omitted. For the components that are named the same, please refer to the descriptions in the above embodiment, and the repeated descriptions will be omitted.

Figure 1B:
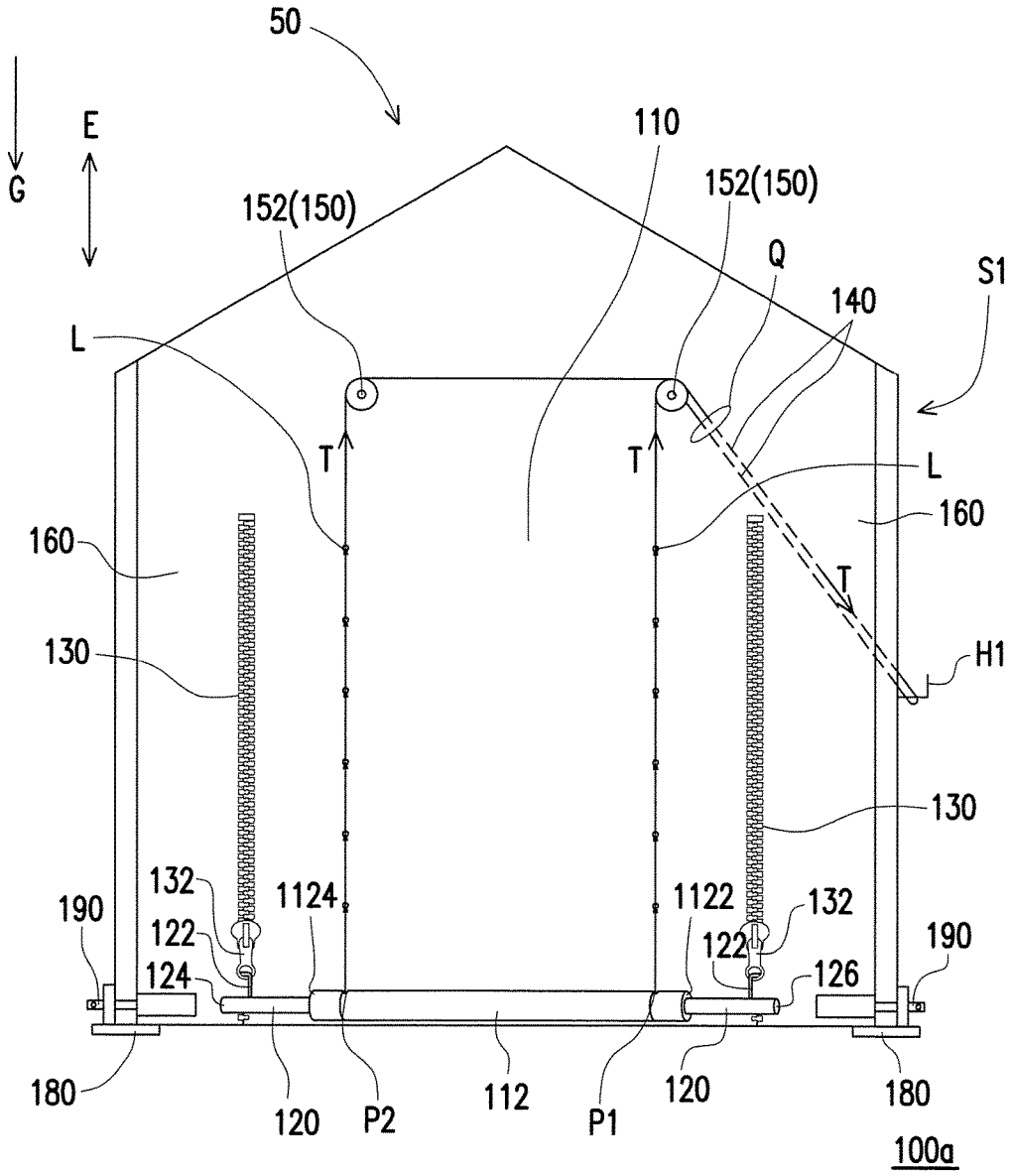
FIG. 1B is an internal schematic diagram of the main body combined with the door opening and closing structure according to another embodiment of the invention.
Figure 2B:
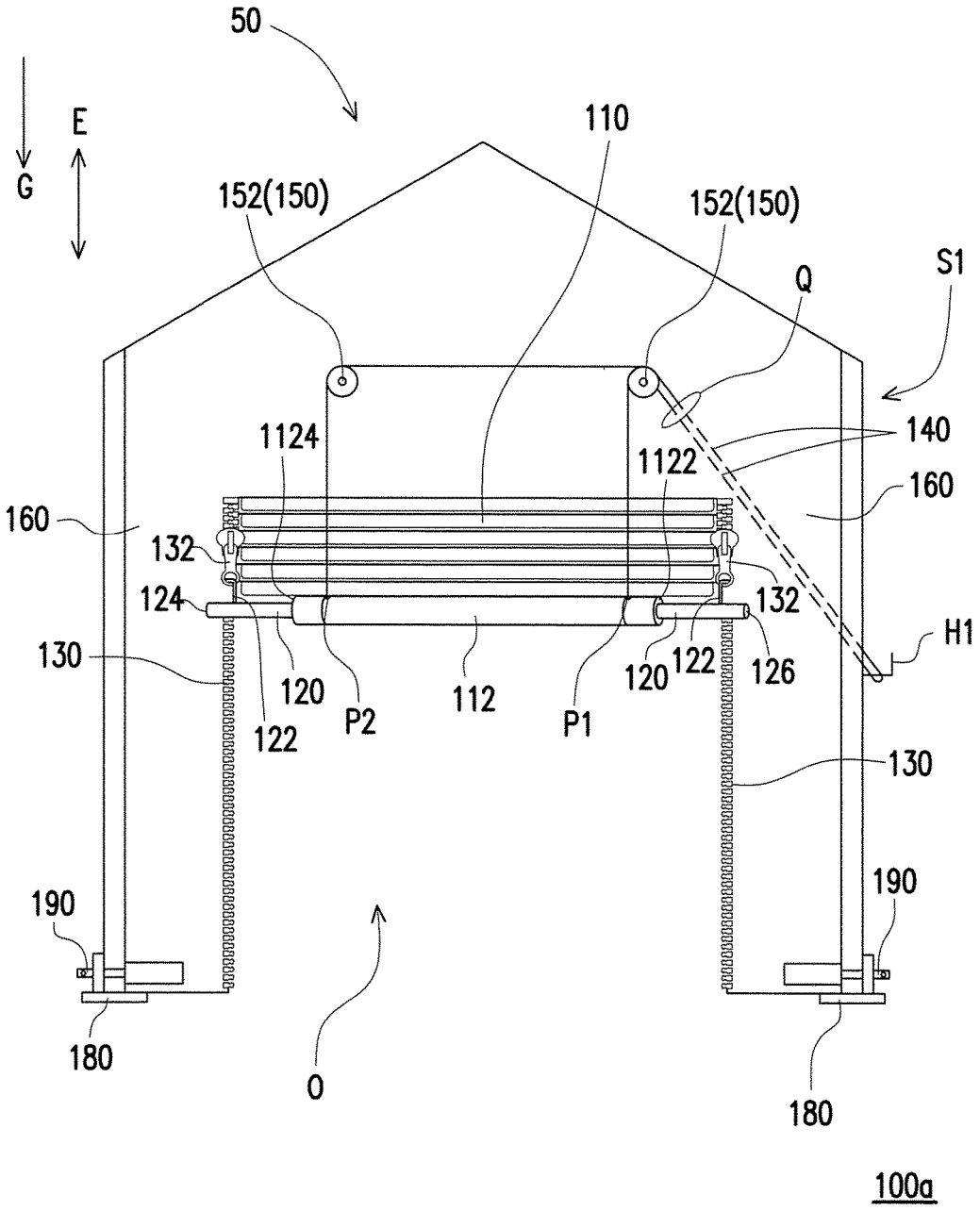
FIG. 2B is a schematic diagram of the state when the door opening and closing structure of the embodiment of FIG. 1B is opened.

FIG. 1B is an internal schematic diagram of the door opening and closing structure according to another embodiment of the invention. FIG. 2B is a schematic diagram of a state when the door opening and closing structure of the embodiment of FIG. 1B is opened. Moreover, the internal schematic diagram of FIG. 1B illustrates a situation when the door opening and closing structure is viewed in a direction from the inside of the main body.

Referring to FIG. 1B and FIG. 2B, in this embodiment, a door opening and closing structure 100*a* is similar to the door opening and closing structure 100 of FIG. 1A and FIG. 2A, and a main difference lies in that: the door opening and closing structure 100*a* further includes a hole Q. Moreover, the transverse bar 120, the zipper 130, a portion of the pulling string 140, and the pulley set 150 of the door opening and closing structure 100*a* are located on the inner side with respect to the door plate 110 (i.e., the inside of the main body 50). Another portion of the pulling string 140 extends outside the main body 50 through the hole Q (outside the tent, as indicated by the dotted lines, for example). Accordingly, the door opening and closing structure 100*a* of this embodiment is able to prevent rain and low temperature from affecting the zipper 130, the transverse bar 120, and the pulley set 150 (i.e., achieve an anti-frost effect).

Figure 4A:
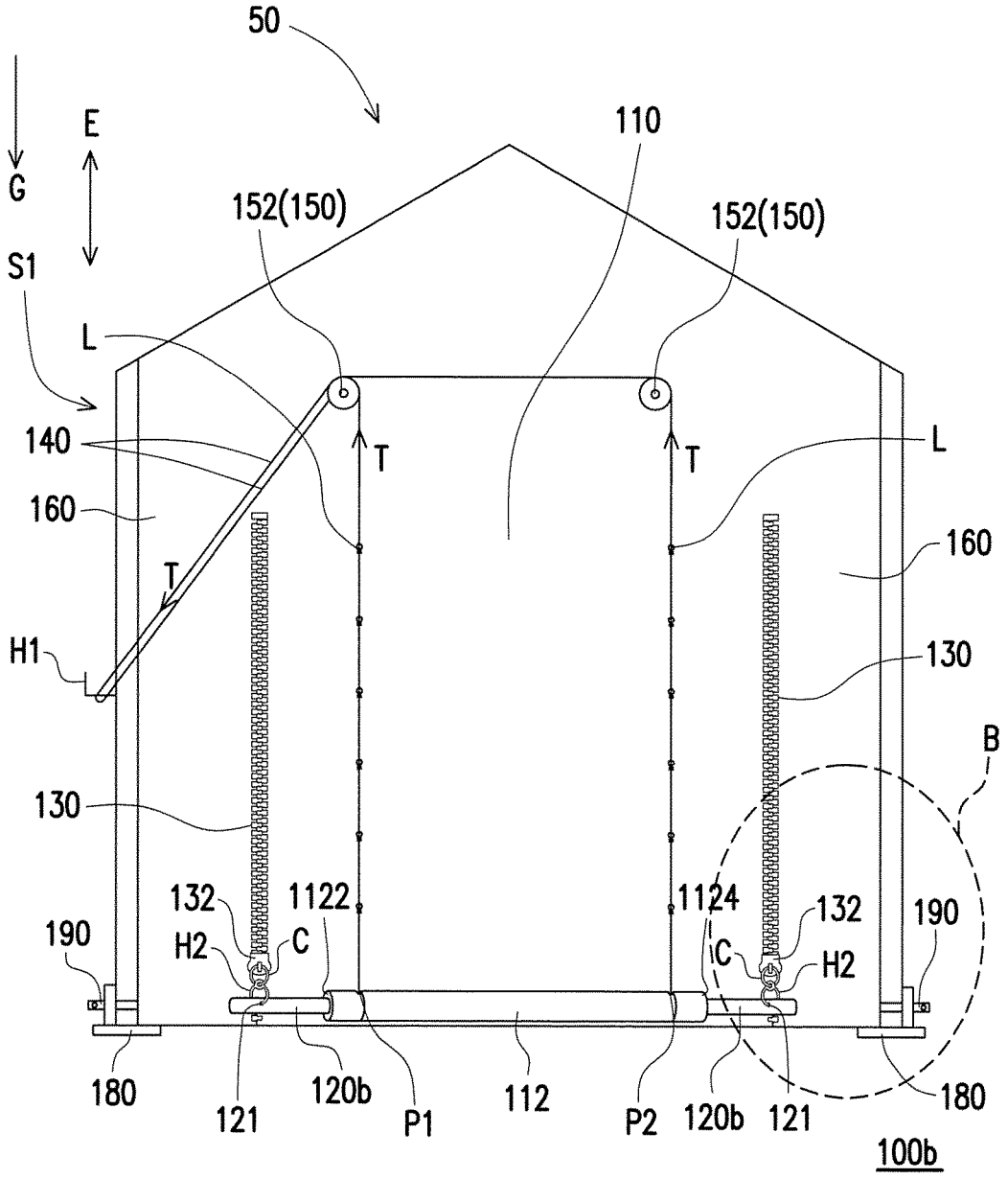
FIG. 4A is an external schematic diagram of the main body combined with the door opening and closing structure according to another embodiment of the invention.
Figure 4B:
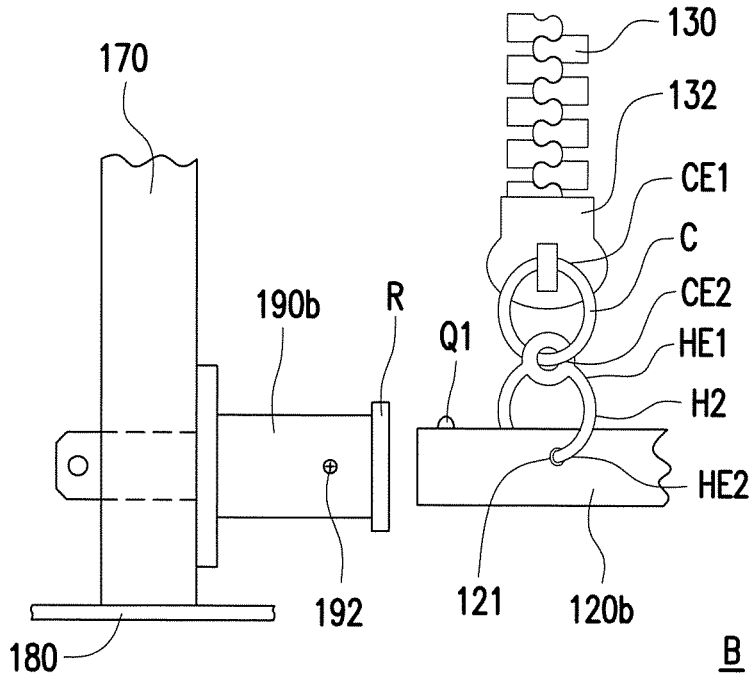
FIG. 4B is an internal schematic diagram of the region B of FIG. 4A when the moving member is not joined to the transverse bar.
Figure 4C:
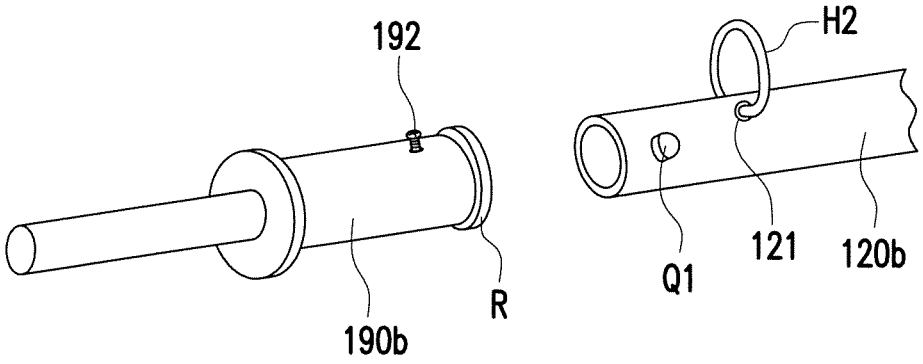
FIG. 4C is a perspective schematic diagram of FIG. 4B.
Figure 4D:
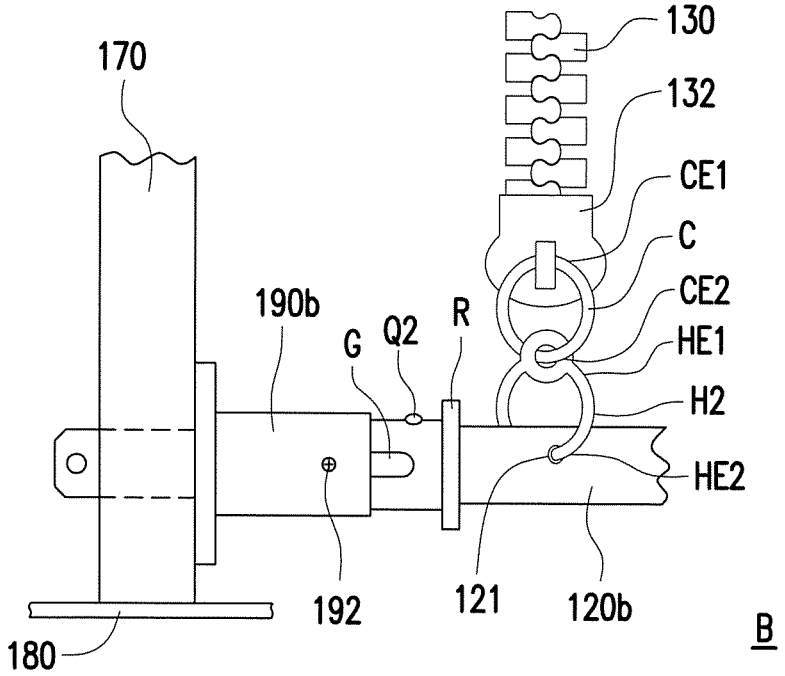
FIG. 4D is an internal schematic diagram of the region B of FIG. 4A when the moving member is jointed to the transverse bar.
Figure 4E:
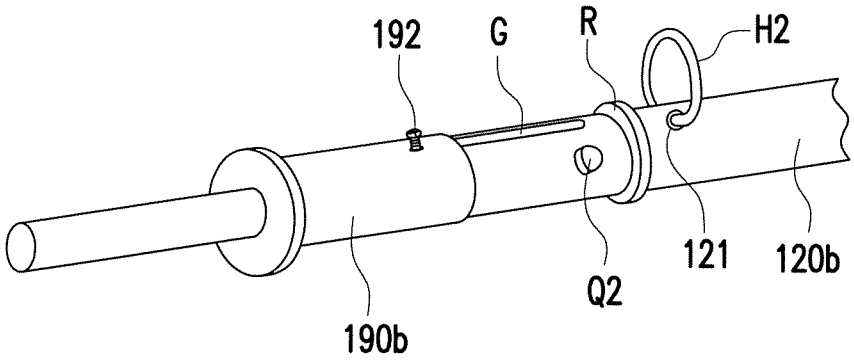
FIG. 4E is a perspective schematic diagram of FIG. 4D.
Figure 4F:
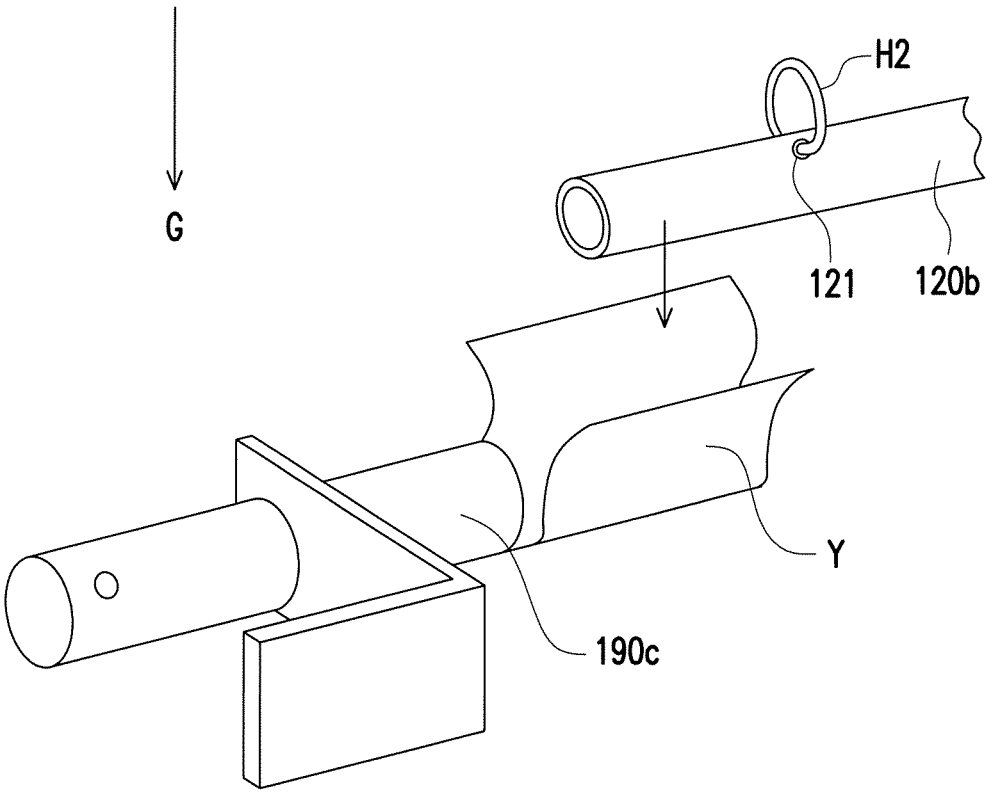
FIG. 4F is a perspective schematic diagram where the fixing pole and the transverse bar of the door opening and closing structure are joined according to yet another embodiment of the invention.

FIG. 4A is an external schematic diagram of the main body combined with the door opening and closing structure according to another embodiment of the invention. FIG. 4B is an internal schematic diagram of a region B of FIG. 4A when a moving member is not joined to the transverse bar. FIG. 4C is a perspective schematic diagram of FIG. 4B. FIG. 4D is an internal schematic diagram of the region B of FIG. 4A when the moving member is jointed to the transverse bar. FIG. 4E is a perspective schematic diagram of FIG. 4D. FIG. 4F is a perspective schematic diagram where the fixing pole and the transverse bar of the door opening and closing structure are joined according to yet another embodiment of the invention. In addition, the external schematic diagram of FIG. 4A illustrates a situation when the door opening and closing structure is viewed in a direction from the outside of the main body, and the internal schematic diagrams of FIG. 4B and FIG. 4D illustrate a situation when the door opening and closing structure is viewed in a direction from the inside of the main body.

Referring to FIG. 4A to FIG. 4E, in this embodiment, a door opening and closing structure 100*b* is similar to the door opening and closing structure 100 of FIG. 1A and FIG. 2A, and a main difference lies in that: in this embodiment, the door opening and closing structure 100*b* further includes a plurality of second hooks H2, a plurality of connection parts C, and a plurality of moving members R. The second hooks H2, the connection parts C, and the moving members R are respectively located on two sides of the door opening and closing structure 100*b*. The number thereof is two, for example, but the invention is not limited thereto. The connection part C is a spiral ring, for example, but the invention is not limited thereto. A transverse bar 120*b* includes a plurality of openings 121. The number of the openings 121 is two, for example, but the invention is not limited thereto. The openings 121 are respectively located on two sides of the transverse bar 120*b*. An end CE1 of one connection part C is disposed through the zipper head 132 of the zipper 130. Another end CE2 of one connection part C is disposed through an end HE1 of one second hook H2. Another end HE2 of one second hook H2 is disposed through one opening 121. That is, in the door opening and closing structure 100*b* of this embodiment, the zipper 130 is connected to the transverse bar 120*b* through the connection part C, the second hook H2, and the opening 121.

Then, referring to FIG. 4A, FIG. 4B, and FIG. 4C, in the door opening and closing structure 100*b* of this embodiment, when the transverse bar 120*b* moves to the bottom of the door plate 110 due to gravity, the door plate 110 is folded toward the inside of the main body 50 to a position corresponding to a fixing pole 190*b*. Referring to FIG. 4B to FIG. 4E, in this embodiment, one moving member R has a sliding groove G. The fixing pole 190*b* has a first housing space (not shown) and a locking part 192. The locking part 192 is a screw, for example, but the invention is not limited thereto. One moving member R is movably disposed in the first housing space. The locking part 192 is disposed through the fixing pole 192*b* to reach the sliding groove G, such that the moving member R is movable relative to the fixing pole 190*b* in an extension direction of the sliding groove G. When the fixing pole 190*b* is not joined to the transverse bar 120*b* (FIG. 4B and FIG. 4C), the user (not shown) rotates the moving member R by an angle in the first housing space to cause the locking part 192 to abut on a portion of the moving member R other than the sliding groove G, such that the moving member R does not move relative to the fixing pole 190*b*. Then, referring to FIG. 4A, FIG. 4D, and FIG. 4E, more specifically, in this embodiment, the transverse bar 120*b* further includes an elastic button Q1. The moving member R further has a second housing space (not shown) and an elastic button hole Q2. When the fixing pole 190*b* and the transverse bar 120*b* are joined (FIG. 4D and FIG. 4E), the transverse bar 120*b* is movably disposed in the second housing space until the elastic button Q1 on the transverse bar 120*b* is engaged with the elastic button hole Q2 of the moving member R, such that the transverse bar 120*b* and the moving member R do not move relative to each other easily. Accordingly, with the aforementioned configuration of the door opening and closing structure 100*b* of this embodiment, when the door plate 110 is swung by an external force (e.g., wind), a torque applied on the zipper head 132 due to the swing is reduced. More specifically, because the fixing pole 190*b* and the transverse bar 120*b* are joined, at least a portion of the torque applied on the zipper head 132 is shared by the fixing pole 190*b* and thus the zipper head 132 is less likely to damage.

Further to the above, when the transverse bar 120*b* of the door opening and closing structure 100*b* of this embodiment is lowered by using the pulling string 140 to cause the door plate 110 to close the opening O, the moving member R is adapted to be pulled out of the first housing space to be joined to the transverse bar 120*b*. Accordingly, with the aforementioned configuration of the door opening and closing structure 100*b* of this embodiment, when the door plate 110 is swung by an external force (e.g., wind), the torque applied on the zipper head 132 due to the swing is reduced. More specifically, because the fixing pole 190*b* and the transverse bar 120*b* are joined, at least a portion of the torque applied on the zipper head 132 is shared by the fixing pole 190*b* and thus the zipper head 132 is less likely to damage.

Referring to FIG. 4F, a fixing pole 190*c* of FIG. 4F is substantially the same as the fixing poles 190 and 190*b* of the aforementioned door opening and closing structures, and a main difference lies in that: in this embodiment, an end of the fixing pole 190*c* further has a Y-shaped opening Y that is opened upward. When the transverse bar 120*b* moves in the gravity direction G to the bottom of the door plate 110 due to gravity, a portion of the transverse bar 120*b* (an end part of the transverse bar 120*b*) is disposed in the Y-shaped opening Y. When the transverse bar 120*b* is pulled up by an external force, the transverse bar 120*b* is less likely to come out of the Y-shaped opening Y to swing back and forth. Likewise, the aforementioned configuration also reduces the torque applied on the zipper head 132 such that the zipper head 132 is less likely to damage.

Figure 5:
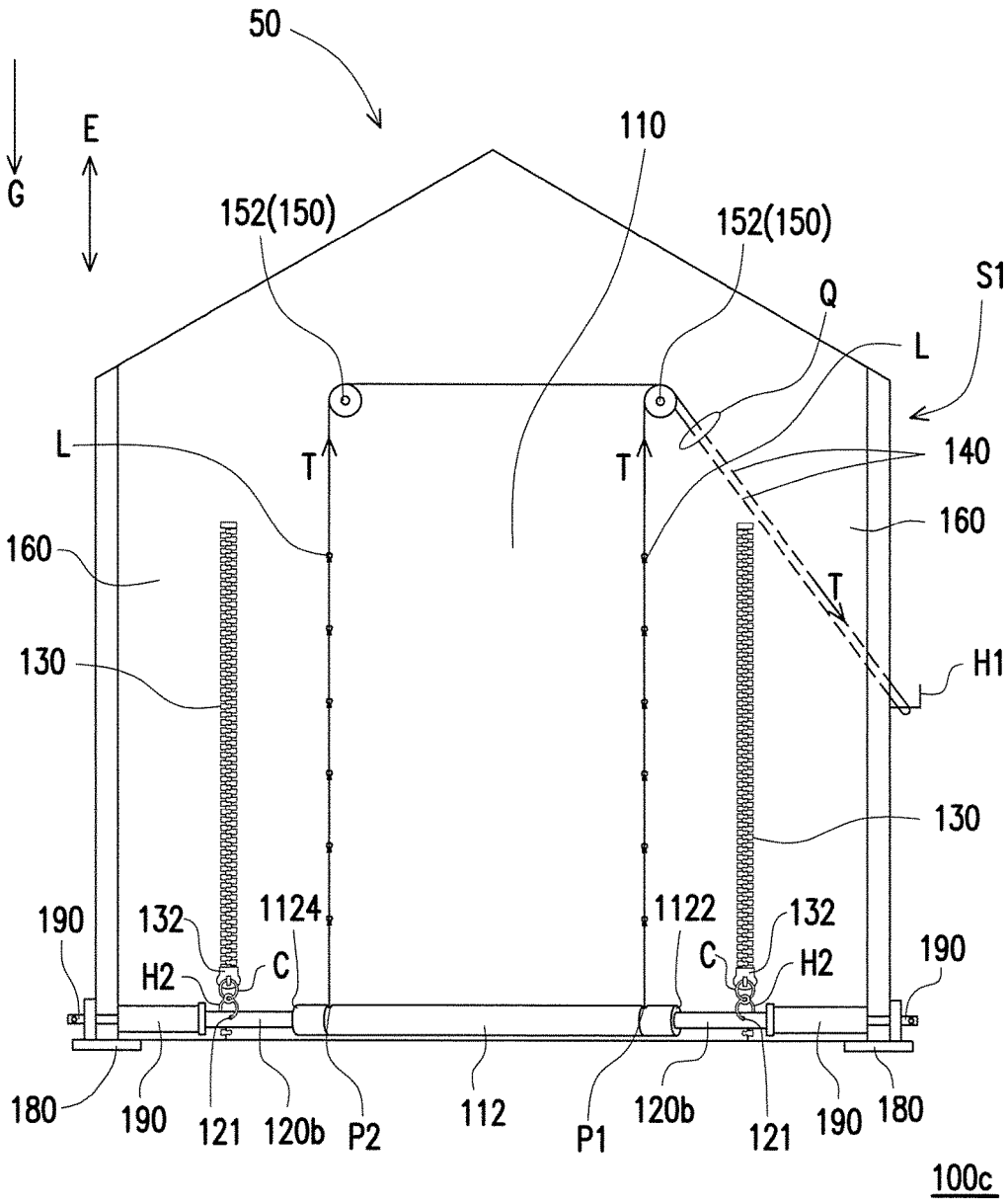
FIG. 5 is a main body internal schematic diagram of the main body combined with the door opening and closing structure according to another embodiment of the invention.

FIG. 5 is an internal schematic diagram of the door opening and closing structure according to another embodiment of the invention. Moreover, the internal schematic diagram of FIG. 5 illustrates a situation when the door opening and closing structure is viewed in a direction from the inside of the main body.

Referring to FIG. 5, a door opening and closing structure 100*c* of this embodiment is similar to the door opening and closing structure 100*b* of FIG. 4A, and a main difference lies in that: the door opening and closing structure 100*c* further includes a hole Q. Moreover, the transverse bar 120, the zipper 130, a portion of the pulling string 140, and the pulley set 150 of the door opening and closing structure 100*c* are located on the inner side with respect to the door plate 110

(i.e., the inside of the main body 50). Another portion of the pulling string 140 extends outside the main body 50 through the hole Q (outside the tent, as indicated by the dotted lines, for example). Accordingly, the door opening and closing structure 100*c* of this embodiment is able to prevent rain and low temperature from affecting the zipper 130, the transverse bar 120, and the pulley set 150 (i.e., achieve an anti-frost effect).

Figure 6A:
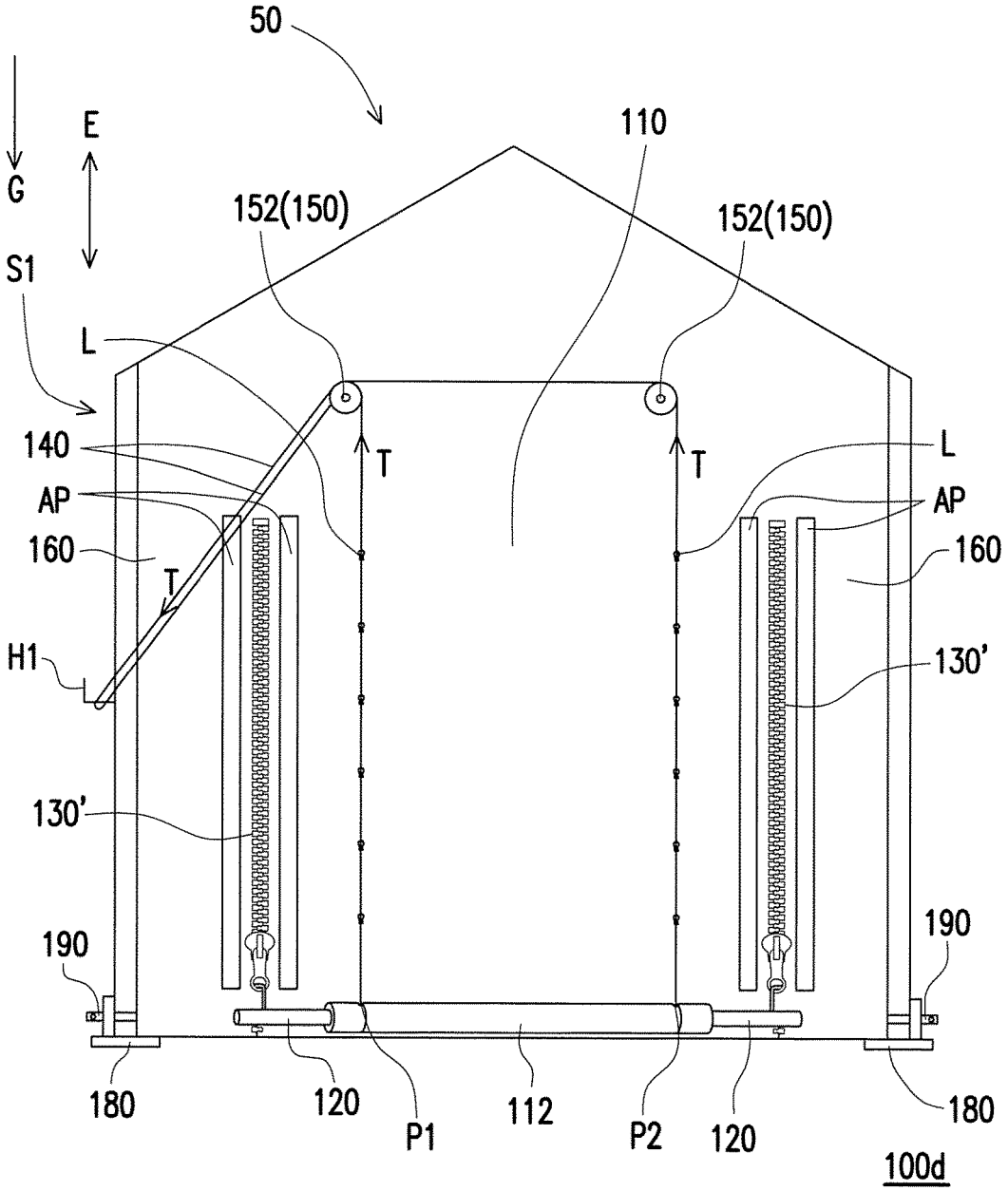
FIG. 6A is an external schematic diagram of the main body combined with the door opening and closing structure according to another embodiment of the invention.
Figure 6B:
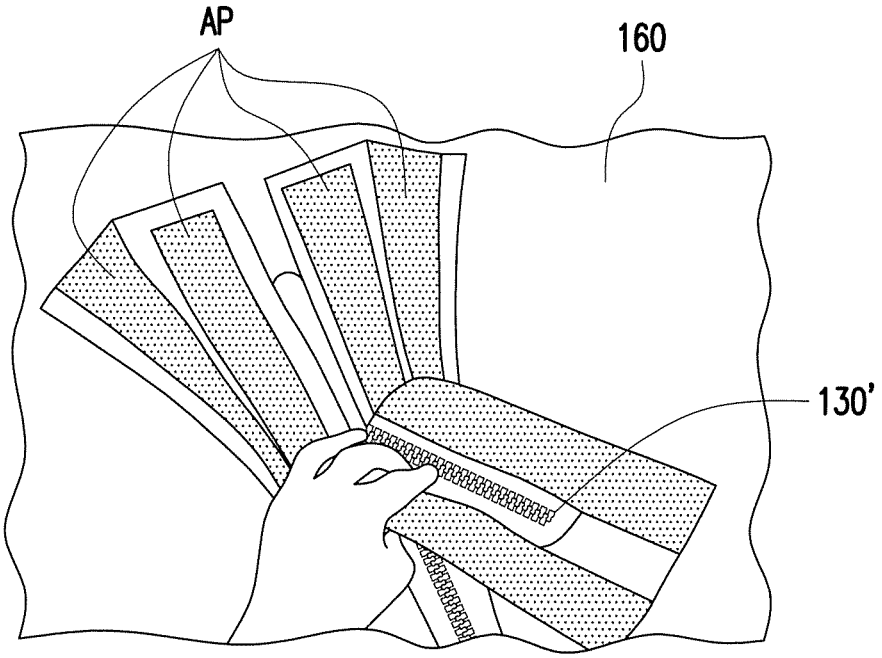
FIG. 6B is a schematic diagram of a process of detaching the detachable zipper of FIG. 6A.

FIG. 6A is an external schematic diagram of the main body combined with the door opening and closing structure according to another embodiment of the invention. FIG. 6B is a schematic diagram of a process of detaching the detachable zipper of FIG. 6A.

Referring to FIG. 6A, in this embodiment, a door opening and closing structure 100*d* is similar to the door opening and closing structure 100 of FIG. 1A, and a main difference lies in that: the door opening and closing structure 100*d* further includes an adhesive part AP. The adhesive part AP may be a velcro, for example. The zipper is a detachable zipper 130'. The adhesive part AP is located on two sides of the detachable zipper 130'. Referring to FIG. 6B, the detachable zipper 130' is connected to the door side plate 160 via the adhesive part AP. More specifically, the detachable zipper 130' adheres to and is fixed to the door side plate 160 via the adhesive part AP. When the detachable zipper 130' is damaged due to an external factor (e.g., wind), the user may open the adhesive part AP for replacing the damaged detachable zipper 130'.

Figure 7A:
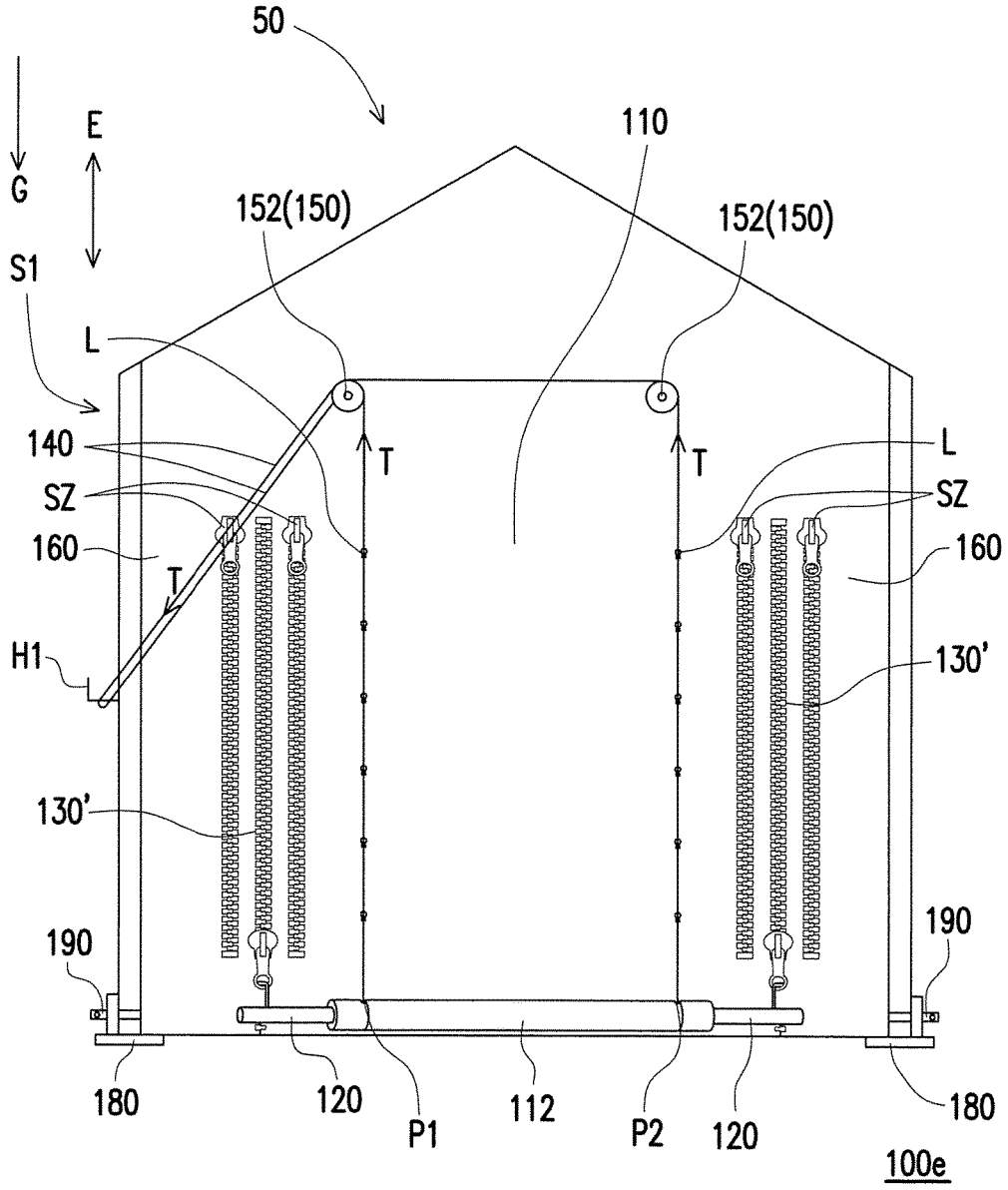
FIG. 7A is an external schematic diagram of the main body combined with the door opening and closing structure according to yet another embodiment of the invention.
Figure 7B:
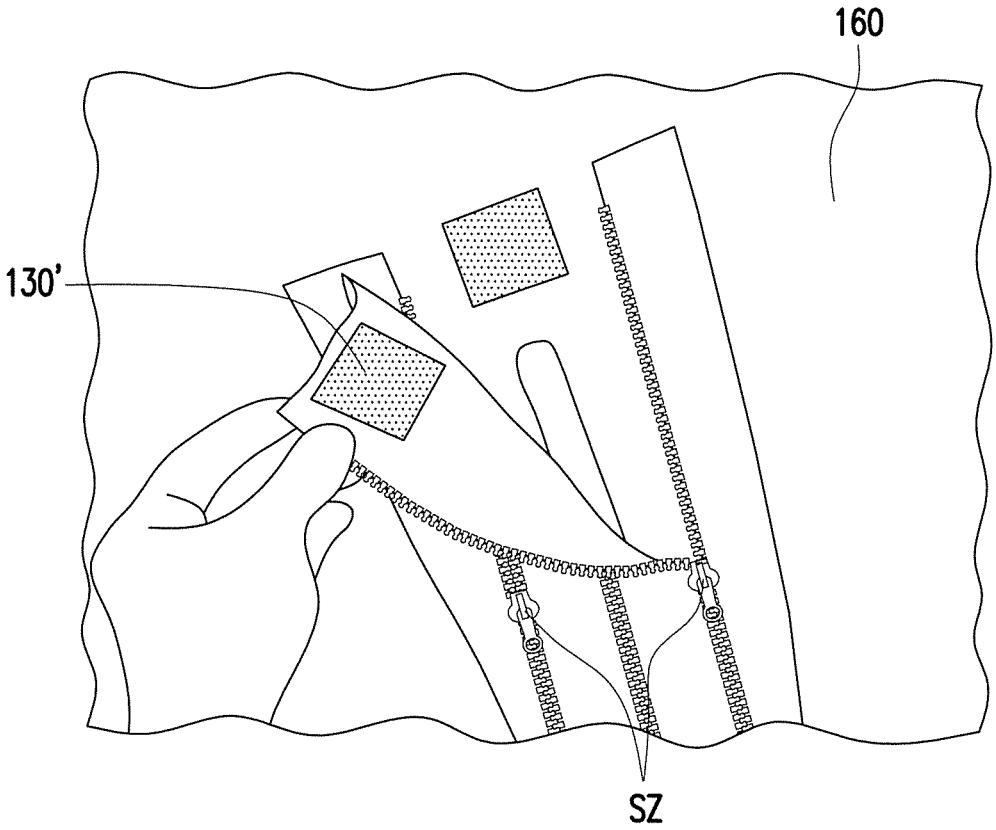
FIG. 7B is a schematic diagram of a process of detaching the detachable zipper of FIG. 7A.

FIG. 7A is an external schematic diagram of the main body combined with the door opening and closing structure according to yet another embodiment of the invention. FIG. 7B is a schematic diagram of a process of detaching the detachable zipper of FIG. 7A.

Referring to FIG. 7A, in this embodiment, a door opening and closing structure 100*e* is similar to the door opening and closing structure 100*d* of FIG. 6A, and a main difference lies in that: the door opening and closing structure 100*e* further includes a sub-zipper SZ. The sub-zipper SZ is located on two sides of the detachable zipper 130'. Referring to FIG. 7B, the detachable zipper 130' is connected to the door side plate 160 via the sub-zipper SZ. When the detachable zipper 130' is damaged due to an external factor (e.g., wind), the user may pull down the sub-zipper SZ on two sides for replacing the damaged detachable zipper 130'. It is worth mentioning that because the sub-zipper SZ of the door opening and closing structure 100*e* is thinner than the adhesive part AP of the door opening and closing structure 100*d*, when the transverse bar 120 is moved up by the tension T, the door plate 110 may be pulled up more evenly.

To sum up, the door opening and closing structure of the embodiments of the invention pulls up (or lowers) the transverse bar via the pulling string, and the pulling string drives the transverse bar to pull open (or close) at least a portion of the zipper, such that the door plate forms (or closes) the opening of the door opening and closing structure. In comparison with the conventional technology, the door opening and closing structure of the embodiments of the invention does not need to open the entrance of the door opening and closing structure in a rolling-up manner, and the operation of forming the opening is easy and convenient.

It will be apparent to those skilled in the art that various modifications and variations can be made to the disclosed embodiments without departing from the scope or spirit of the invention. In view of the foregoing, it is intended that the invention covers modifications and variations provided that they fall within the scope of the following claims and their equivalents.

What is claimed is:

1. A door opening and closing structure, adapted to be combined with a main body to shield or open a space in the main body, the door opening and closing structure comprising:

a door plate;

a transverse bar, connected to the door plate;

a zipper, the transverse bar is connected to the zipper; and a pulling string, the pulling string is connected to the transverse bar, wherein when a tension is applied on the pulling string and the tension is greater than a gravity of the transverse bar and at least a portion of the door plate, the transverse bar is pulled by the pulling string along an extension direction of the zipper to pull open at least a portion of the zipper, and the at least a portion of the door plate is driven by the transverse bar to move along the extension direction to form an opening, and when the tension is less than the gravity of the transverse bar and the at least a portion of the door plate, the transverse bar moves along a gravity direction to close the at least a portion of the zipper and the door plate is driven by the transverse bar to move along the gravity direction to reduce the opening.

2. The door opening and closing structure according to claim 1, further comprising a pulley set, wherein the pulling string is disposed around the pulley set and tied to the transverse bar, and the pulley set changes a transmission direction of the tension applied on the pulling string.

3. The door opening and closing structure according to claim 2, wherein the pulley set comprises a plurality of fixed pulleys, and the fixed pulleys are located on the door plate.

4. The door opening and closing structure according to claim 3, wherein the fixed pulleys are double groove fixed pulleys.

5. The door opening and closing structure according to claim 1, wherein the door plate further comprises a sleeve located at a bottom of the door plate, and the transverse bar is disposed through the sleeve.

6. The door opening and closing structure according to claim 5, wherein the pulling string is respectively tied to a first position and a second position of the sleeve, and the first position and the second position are respectively adjacent to two opposite ends of the sleeve.

7. The door opening and closing structure according to claim 1, further comprising a door side plate, wherein the door side plate is located on two sides of the door plate, and the door plate and the door side plate are connected by the zipper.

8. The door opening and closing structure according to claim 7, wherein the main body further comprises an upright post and a base, and the door opening and closing structure further comprises a fixing pole and a door side plate fixing buckle, wherein the upright post supports the door side plate and is disposed on the base, the fixing pole is disposed through the base and is fixed to the door side plate, and the door side plate fixing buckle is fixed to the door side plate and the fixing pole.

9. The door opening and closing structure according to claim 8, further comprising a plurality of moving members, wherein one of the moving members comprises a sliding groove, the fixing pole comprises a housing space and a locking part, one of the moving members is movably disposed in the housing space, the locking part is disposed through the fixing pole to reach the sliding groove such that the moving member is movable relative to the fixing pole in an extension direction of the sliding groove, and the transverse bar and the moving member are joined to each other.

10. The door opening and closing structure according to claim 1, wherein the transverse bar further comprises a connection buckle, and the connection buckle of the transverse bar is buckled to the zipper.

11. The door opening and closing structure according to claim 10, wherein the connection buckle is close to two ends of the transverse bar, and the connection buckle is buckled to a zipper head of the zipper.

12. The door opening and closing structure according to claim 1, further comprising a plurality of positioning parts that are disposed along an extension direction of the pulling string to position the pulling string.

13. The door opening and closing structure according to claim 1, further comprising a first hook, wherein the pulling string is adapted to be fixed to the first hook.

14. The door opening and closing structure according to claim 1, further comprising a plurality of second hooks and a plurality of connection parts, wherein the transverse bar comprises a plurality of openings that are respectively located on two sides of the transverse bar, and an end of one of the connection parts is disposed through the zipper head of the zipper, another end of one of the connection parts is disposed through an end of one of the second hooks, and another end of one of the second hooks is disposed through one of the openings.

15. The door opening and closing structure according to claim 7, further comprising an adhesive part, wherein the zipper is a detachable zipper, and the adhesive part is located on two sides of the detachable zipper, wherein the detachable zipper is connected to the door side plate via the adhesive part.

16. The door opening and closing structure according to claim 7, further comprising a sub-zipper, wherein the zipper is a detachable zipper, and the sub-zipper is located on two sides of the detachable zipper, wherein the detachable zipper is connected to the door side plate via the sub-zipper.

* * * * *